US005417641A

United States Patent [19]

Warren

[11] Patent Number: 5,417,641

[45] Date of Patent: May 23, 1995

[54] DEVICE FOR FOLDING ARTICLES

[76] Inventor: James M. Warren, 2542 Burwick Walk, Snellville, Ga. 30278

[21] Appl. No.: 103,182

[22] Filed: Aug. 5, 1993

[51] Int. Cl.[6] ..... B65H 45/12

[52] U.S. Cl. ..... 493/405; 493/474; 493/478

[58] Field of Search ..... 493/405, 474, 477, 478, 493/964

[56] References Cited

U.S. PATENT DOCUMENTS

| | | | |
|---|---|---|---|
| 924,761 | 6/1909 | Goodman | 229/87.17 |
| 1,018,905 | 2/1912 | Herman | 229/87.17 |
| 1,852,604 | 4/1932 | Canfiled | 223/71 |
| 2,362,976 | 11/1944 | Cooper | 493/405 |
| 2,549,386 | 4/1951 | Reign | 493/405 |
| 3,308,723 | 3/1967 | Bergh | 493/354 |
| 3,400,640 | 9/1968 | Randles | 493/137 |
| 4,190,151 | 2/1980 | Russell | 206/281 |
| 4,240,553 | 12/1980 | Leopold | 206/492 |
| 4,421,500 | 12/1983 | Smith | 493/405 |
| 4,498,895 | 2/1985 | White | 493/478 |
| 4,636,192 | 1/1987 | Vogtlander et al. | 493/405 |
| 4,865,579 | 9/1989 | Kirby et al. | 493/405 |
| 5,154,329 | 10/1992 | Dorfmueller | 223/37 |
| 5,308,051 | 5/1994 | Spitzmesser | 493/405 |

OTHER PUBLICATIONS

1 Page brochure dated Nov. 19, 1993, from Winner's Choice Embroidery.

*Primary Examiner*—William E. Terrell

*Attorney, Agent, or Firm*—Bernstein & Associates

[57] ABSTRACT

A device for folding flexible articles such as shirts, towels, piece goods and the like comprising a generally flat main member with two side panels foldably attached to the main member. A base attached to the main member supports the main member and elevates it above a support surface and comprises a generally flat base member and four side panels that each fold and lock in place to form the sides of the base support. The device is preferably made of corrugated cardboard and scored or perforated at the various fold lines. The device can be expanded for flat storage and folded for use.

4 Claims, 8 Drawing Sheets

DEVICE FOR FOLDING ARTICLES

FIELD OF THE INVENTION

The present invention relates to a device useful for folding articles and more particularly to a device for rapidly folding shirts and other articles which can be stored in a substantially flat configuration when not in use.

BACKGROUND OF THE ART

Commercial clothing printing companies must process thousands of articles daily. One of the final steps after drying of the printed material is folding of the article, such as a T-shirt, sweat shirt, sweater, towel, piece goods or the like. Unless a large mechanized folding device is employed, at a cost of thousands of dollars, the printer is relegated to laboriously hand folding each item, involving substantial time and labor, reducing profitability. Furthermore, since each person in the folding operation may fold the article slightly differently, uniformity may be compromised and efficient packing in boxes may not be optimal.

Several patents have been granted for garment folding devices which are directed to paper or cardboard shaper inserts that are folded and remain integral with the garment to maintain the garment shape in a folded position. Such patents include U.S. Pat. No. 924,761; No. 1,018,905; No. 1,852,604; No. 4,190,151; No. 4,240,553, and No. 5,154,329. These patents fail to address the problem of folding large numbers of garments without utilizing one folding device per garment that remains with the garment. Furthermore, none of these inventions can be conveniently used with other items such as towels, skirts, underwear or the like.

It would be desirable for an inexpensive, storable article folding device to be capable of folding a number of different types of garments or other items in a rapid manner with a high degree of reproducibility.

SUMMARY OF THE INVENTION

The present invention provides an inexpensive device for folding individual articles in a rapid reproducible manner. In general, the present invention comprises a generally flat main member with two side panels foldably attached to the main member. A base is attached to and supports the main member and elevates it above a support surface for easier operation. The base comprises a generally flat base member and four side panels that each fold and lock in place to form the sides of the base. The base can be expanded for flat storage and folded for use. The device is preferably made of corrugated cardboard and scored or perforated at the various fold lines. The present invention can be configured for use in seconds without difficulty or tools.

Generally described, the present invention comprises a device for folding articles such as piece goods, shirts and other clothing, linens and towels and the like and having an expanded configuration adapted for storage and a folded configuration for use on a surface, comprising a generally flat rectangular-shaped main member having first and second sides and top and bottom edges having a first fold line extending longitudinally along the first side from the top edge to the bottom edge and a second fold line extending longitudinally along the second side of the main member from the top edge to the bottom edge, the first and second fold lines dividing the main member into two approximately equal side sections and a mid-section; and, a base attached to the mid-section of the main member and having an expanded configuration and a folded configuration, such that the base can support and maintain the main member in a raised position above a flat surface for facilitating folding of the first and second side sections of the main member.

More particularly, provided is a device for folding articles, comprising a generally flat rectangular-shaped main member having first and second sides and top and bottom edges having a first fold line extending longitudinally along said first side from said top edge to said bottom edge and a second fold line extending longitudinally along said second side of said main member from said top edge to said bottom edge, said first .and second fold lines dividing said main member into two approximately equal side sections and a mid-section; a first generally rectangular-shaped arm member extending laterally from an upper corner of said first side section and a second generally rectangular-shaped arm member extending laterally from an upper corner of said second side section wherein each said arm member is dimensioned to be generally larger than the sleeve width of a conventional adult shirt; and a base attached to said mid-section of said main member and having an expanded configuration and a folded configuration comprising a generally flat rectangular-shaped base member having, first and second sides and top and bottom edges, a generally rectangular shaped first side panel extending from said first side of said base member having an inner edge foldably attached to said first side of said base member at a first fold line, an outer edge having at least one tab extending therefrom, a top edge having a tab foldably extending therefrom and a bottom edge having a tab foldably extending therefrom, a perforated second fold line extending longitudinally along and generally midway between said outer and said inner edges of said first side panel, a generally rectangular shaped second side panel extending from said second side of said base member having an inner edge foldably attached to said second side of said base member at a third fold line, an outer edge having at least one tab extending therefrom, a top edge having a tab foldably extending therefrom and a bottom edge having a tab foldably extending therefrom, a perforated fourth fold line extending longitudinally along and generally midway between said outer and said inner edges of said second side panel, a generally rectangular shaped top panel extending from said top of said base member having an inner edge foldably attached to said top of said base member at a fifth fold line, an outer edge having at least one tab extending therefrom, a perforated sixth fold line extending horizontally along and generally midway between said outer and said inner edges of said top panel, and a generally rectangular shaped bottom panel extending from said bottom of said base member having an inner edge foldably attached to said bottom of said base member at a seventh fold line, an outer edge having at least one tab extending therefrom, a perforated eighth fold line extending horizontally along and generally midway between said outer and said inner edges of said bottom panel, wherein each of said sides, top and bottom of said base member has at least one aperture defined along the corresponding first, third, fifth and seventh fold lines therein dimensioned to receive said at least one tab on said outer edge of said foldably attached corresponding panels such that when said panels are folded along said perforated second, fourth, sixth and eight fold lines, and said first, third, fifth and seventh fold lines, said tabs can be inserted into said apertures to maintain said panels in a folded position.

Accordingly, it is a principal object of the present invention to provide a device for folding shirts and other articles.

It is an additional object of the present invention to provide a device that will fold articles in a rapid and reproducible manner.

It is a further object of the present invention to provide a device for folding articles that can be made and delivered for storage in a flat configuration and folded into a set up configuration for use.

Other objects, features, and advantages of the present invention will become apparent upon reading the following detailed description of embodiments of the invention, when taken in conjunction with the accompanying drawing and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
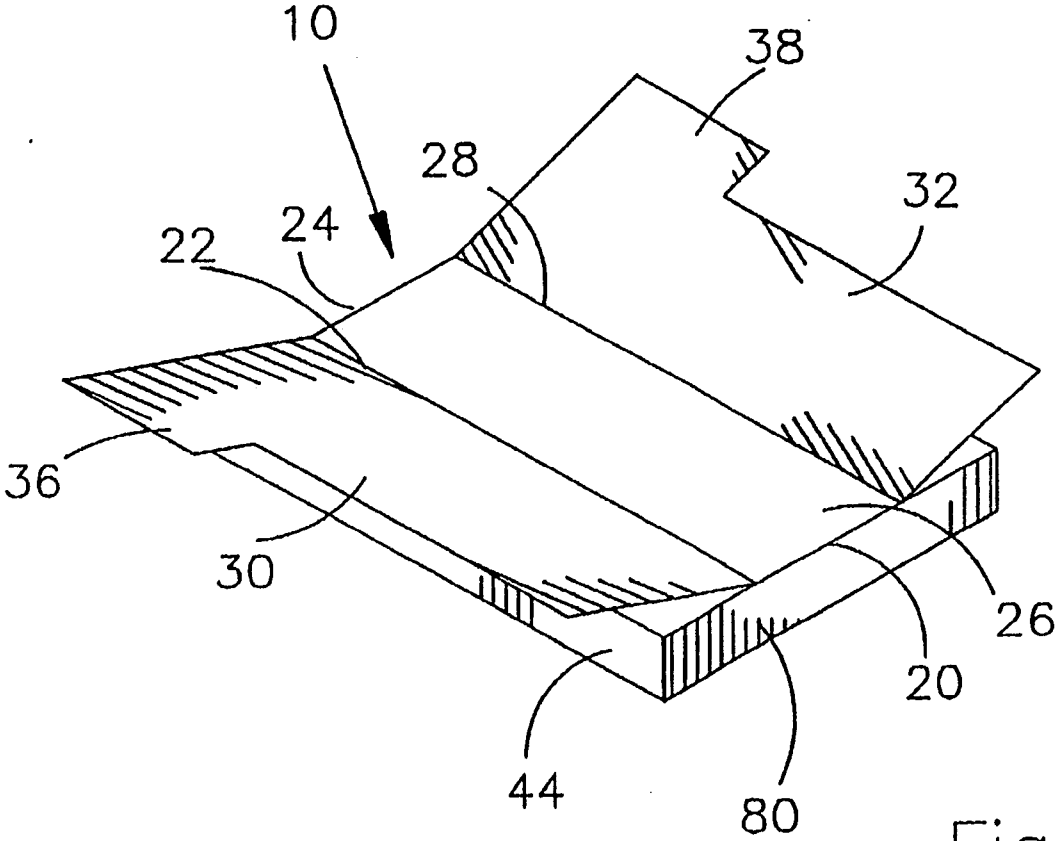
FIG. 1 shows a perspective view of the present invention with a T-shirt positioned for folding shown in phantom.
Figure 2:
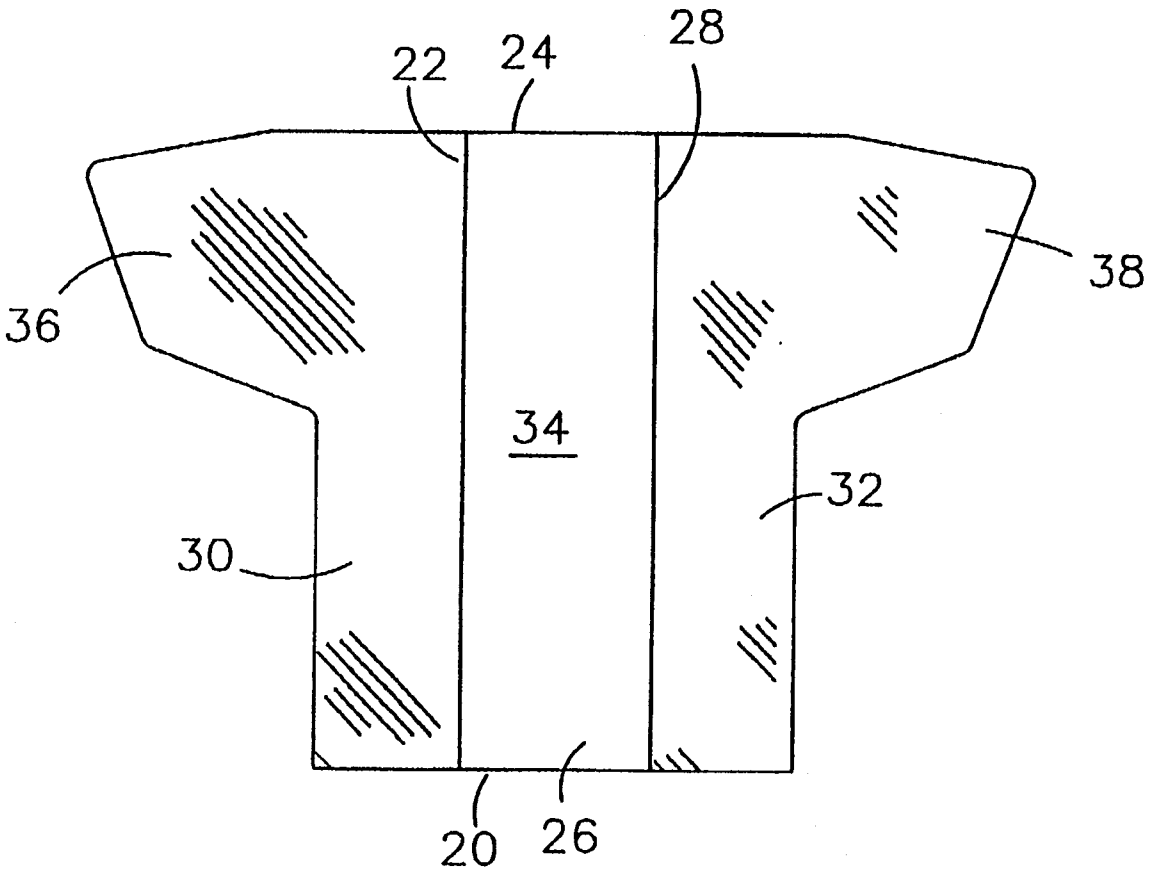
FIG. 2 shows a top view of the present invention.

FIGS. 1 and 2 show a preferred embodiment of the present invention with a device indicated generally as number 10. Any suitable foldable material can be used. The device 10 is preferably made of corrugated cardboard, which is inexpensive, durable, foldable and scorable. Other materials are usable, such as paperboard, foldable plastic sheet, Plexiglas, wood, metal, glass, fiber or particle board, or the like and are contemplated as being within the scope of the present invention. It is to be understood that the fold or perforation lines discussed herein can also be hinges attached to appropriate parts of the invention. However, for the purposes of the present discussion, folds in the cardboard, made by simple folding, bending, scoring, perforation or the like, will be discussed.

A generally flat rectangular-shaped main member 20 is cut as indicated in FIG. 2 and has a first fold line 22 extending longitudinally from a top edge 24 to a bottom edge 26. The fold line is accomplished by scoring the cardboard. The main member 20 has a second fold line 28 extending longitudinally from the top edge 24 to the bottom edge 26. The first and second fold lines 22 and 28 divide the main member 20 into three sections: a first side section 30, a second side section 32, and a mid-section 34. The first and second side sections 30 and 32 can fold inwardly toward the mid-section 34.

Although it is not required, the present invention preferably has a generally rectangular-shaped arm member 36 extending laterally from an upper corner of the first side section 30 and a generally rectangular-shaped arm member 38 extending laterally from an upper corner of the second side section 32. The arm members 36 and 38 support the sleeves of larger sized shirts during the folding process, as described in detail hereinbelow.

Figure 3:
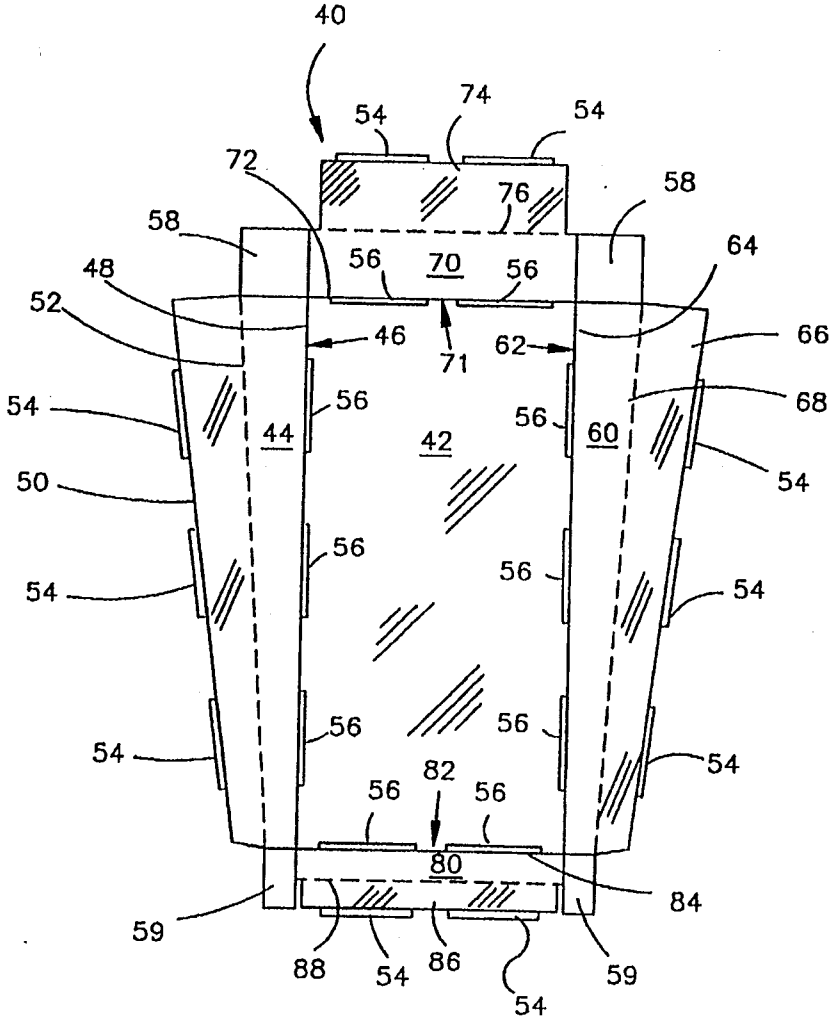
FIG. 3 shows a bottom view of the base of the present invention.
Figure 4:
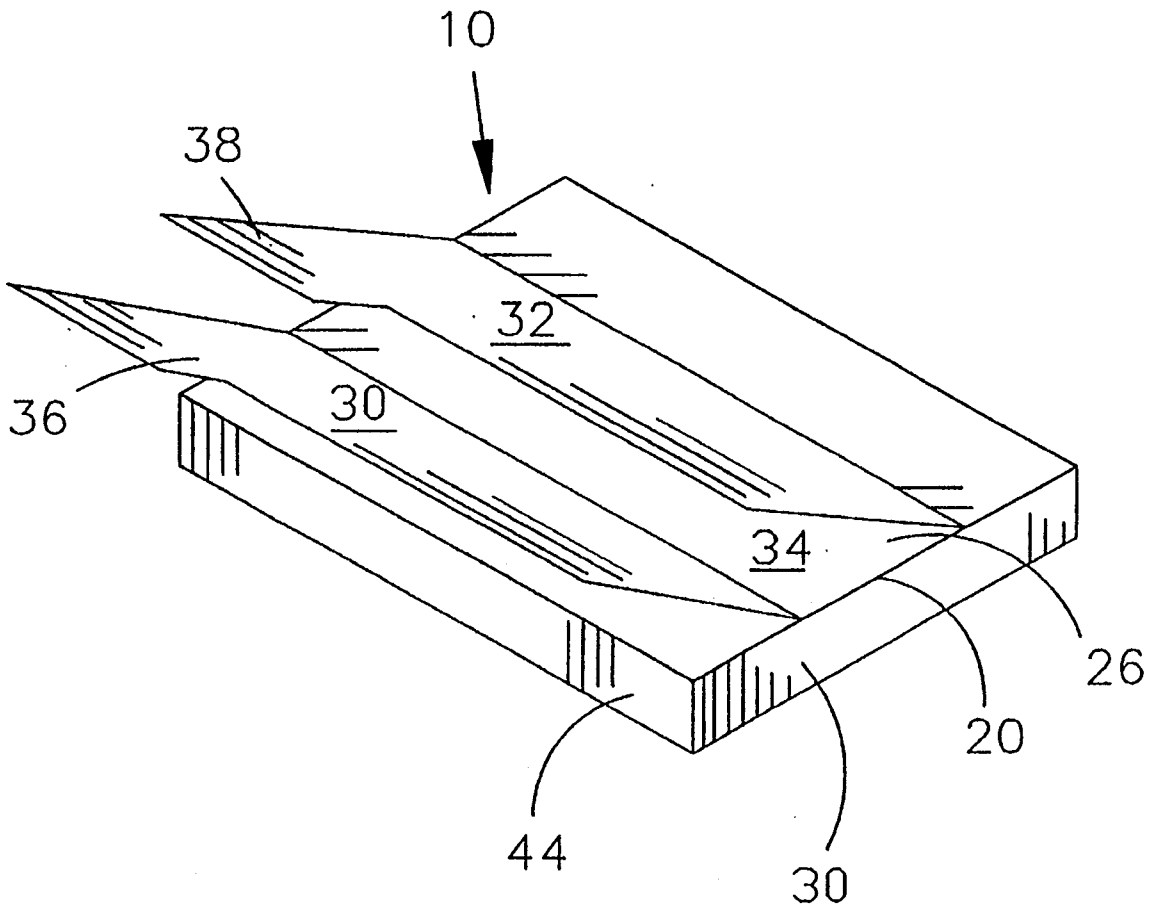
FIG. 4 shows a perspective view of the present invention with one side section folded over the mid-section.

FIG. 3 shows a base 40 supports the main member 20 above a flat surface. A base member 42 comprises a generally flat rectangular-shaped piece of material, again, preferably corrugated cardboard, or a material as discussed above. The base member 42 is attached to the underside of the main member 20 by glue, staples, screws, nails, nuts and bolts, or the like. A first panel 44 extends longitudinally outward from and is foldably connected to a first edge 46 forming a first fold line 48. The panel 44 has a first outer edge 50 which is generally parallel to the first edge 46, or, as described in detail hereinbelow, can be slightly angled to present an angled support base when assembled. A perforated second fold line 52 extends longitudinally approximately mid-way between the outer first edge 50 and the first edge 46. Preferably, the perforation is two parallel lines of perforation, which permits more precise folding and less strain on the material. At least one, and preferably a series of, tabs 54 extend from the outer edge 50 which are aligned with a similar number of apertures 56 disposed in the base member 42 along the first fold line 48. When the first panel 44 is folded at the first fold line 48 and second fold line 52 the tabs 54 can be inserted into the corresponding aperture 56, thereby removably locking the first panel 44 in the folded position. Tabs 58 and 59 are foldably attached to the top and bottom ends of the first panel 44, as shown.

A second panel 60 extends longitudinally outward from and is foldably connected to a second edge 62 forming a third fold line 64. The second panel 60 is essentially a mirror image of the first panel 44 and has a second outer edge 66, a fourth perforated fold line 68, at least one tab 54, a corresponding number of apertures 56, a top tab 58 and a bottom tab 59, each correspondingly and foldably attached to the top and bottom edges of the second panel 60.

A third panel 70 extends longitudinally outward from and is foldably connected to the top edge 71 of base member 42 at a fifth fold line 72. Generally similar to the first and second panels 44 and 60, the third panel 70 has an third outer edge 74, a sixth perforated fold line 76, at least one tab 54 and at least one corresponding aperture 56 aligned with each tab on the top edge 71. There are preferably no tabs at either end of the third panel 70.

A fourth panel 80 extends longitudinally outward from and is foldably connected to a bottom edge 82 forming a seventh fold line 84. Generally similar to the third panel 70, the fourth panel 80 has a fourth outer edge 86, an eighth perforated fold line 88, at least one tab 54 and at least one corresponding aperture 56 aligned with each tab on the bottom edge 82. There are preferably no tabs at either end of the fourth panel 80.

In manufacture, the device 10 is made in two parts, the main member 20 and the base 40 and glued together. The device is provide in the expanded, unfolded, configuration for shipping and storage, When used the base 40 is folded to provide a stable support for the device 10.

In order to effect proper folding of the base 40, the four panels 44, 60, 70 and 80 are folded inwardly at the first, third, fifth and seventh fold lines 48, 64, 72, and 84, respectively, along the edges of base member 40, The top and bottom tabs 58 and 59 are folded inwardly toward their respectively attached panels and inside the third and fourth panels 70 and 80 for greater structural stability and support, The panels are folded at the second, fourth, sixth and eighth fold lines 52, 68, 76 and 88, respectively, so that the tabs 54 are inserted into the corresponding apertures 56. This locks the panels in place for stability. When the device 10 is to be stored, the panels are unfolded and flattened.

Figure 5:
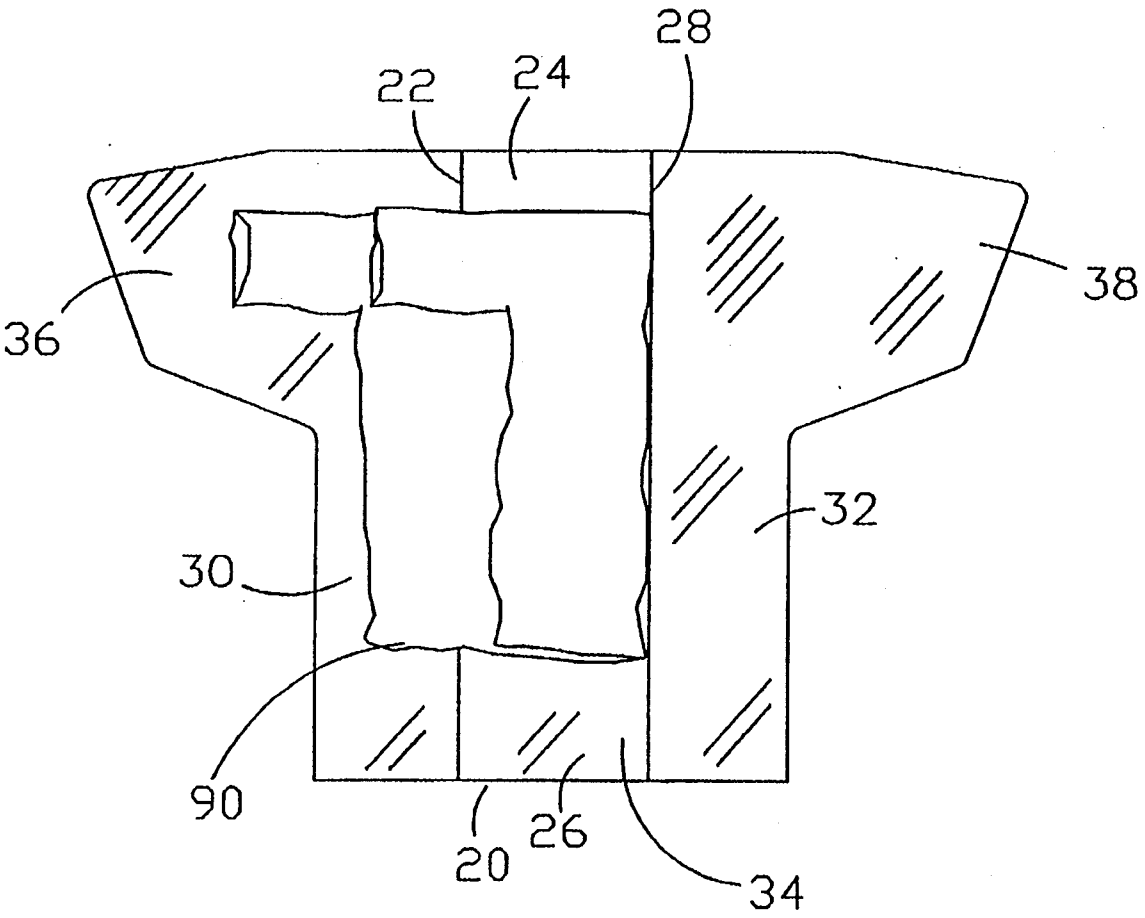
FIG. 5 shows a perspective view of a shirt after a first folding step.
Figure 6:
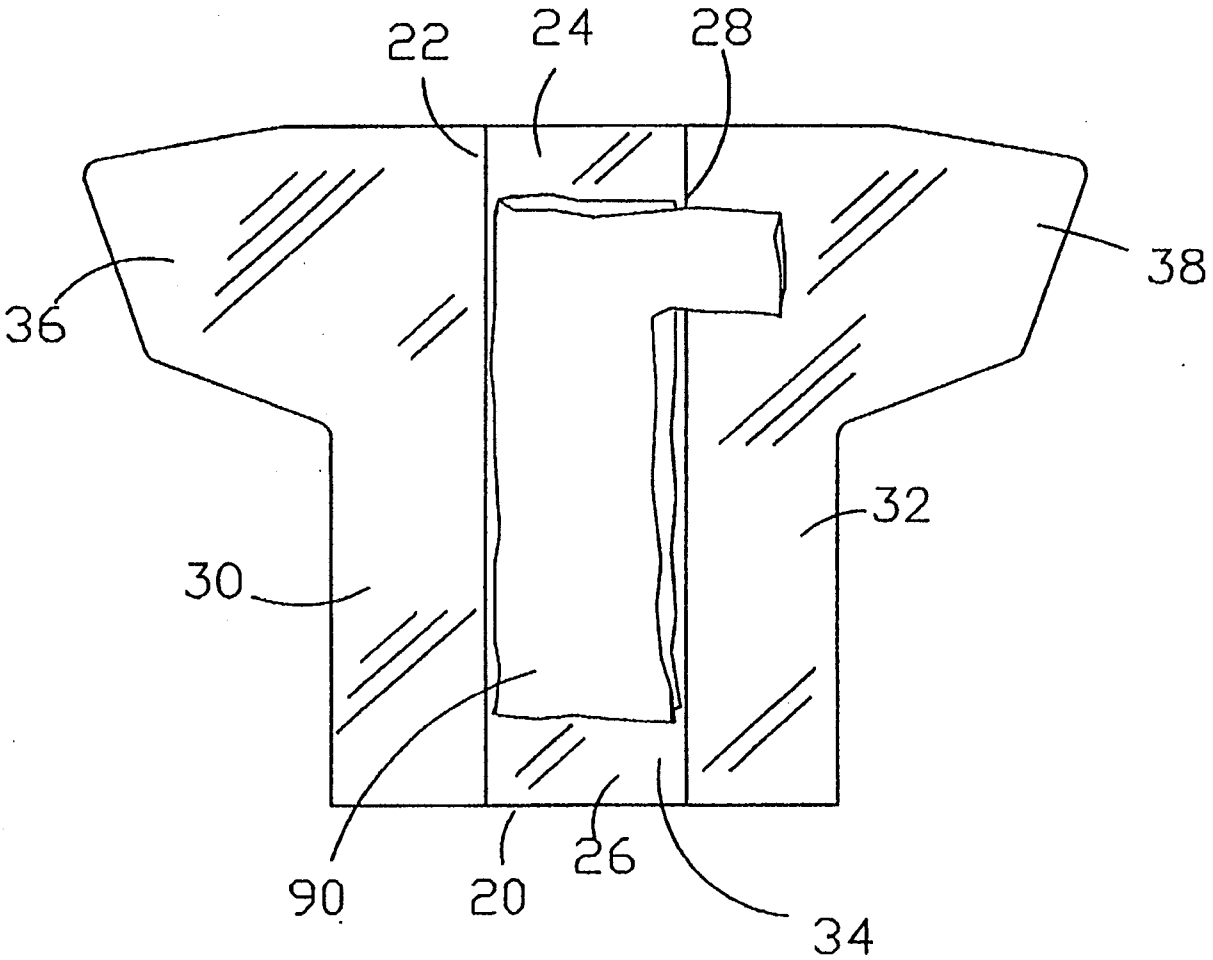
FIG. 6 shows a perspective view of a shirt after a second folding step.
Figure 7:
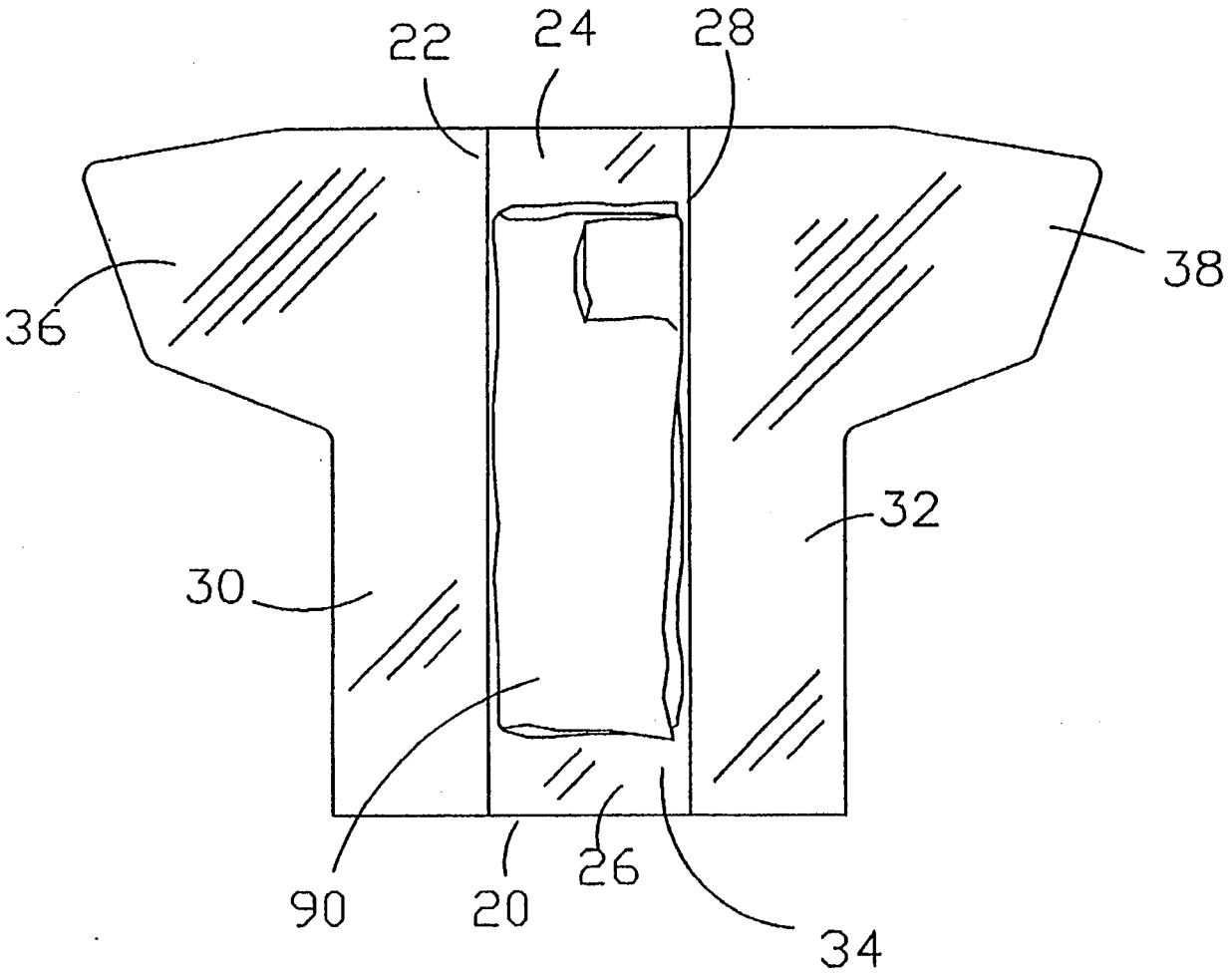
FIG. 7 shows a top view of a shirt after a third folding step.
Figure 8:
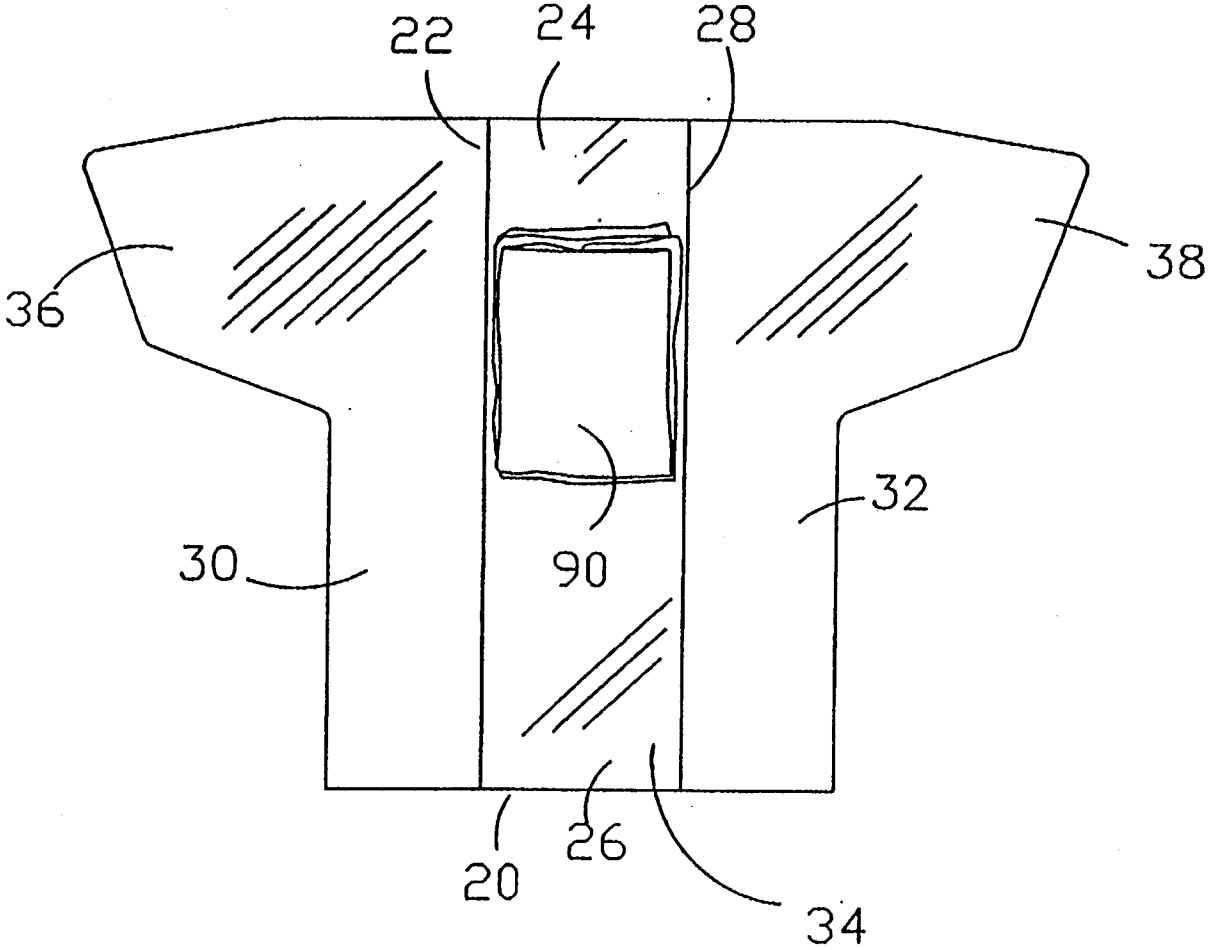
FIG. 8 shows a top view of a shirt after folding is complete.

In order to use the device of the present invention after it is assembled, a shirt 90, such as a T-shirt, is laid front down on the main member 20, positioned approximately in the middle (horizontally) and towards the top, as shown in FIG. 1. The first side section 30 is folded inwardly at fold line 22 so as to fold one side of the shirt 90 over the central part of the shirt, as shown in FIG. 5, and then the section 30 is unfolded back to its flat position. The second side section 32 is folded over at fold line 28 to fold the other side of the shirt 90, as shown in FIG. 6. The last folding operation is achieved by folding the first side section 30 inward again to fold the sleeve of the shirt 90 toward the body of the shirt, as shown in FIG. 6. The bottom of the shirt 90 is then folded upward toward the center of the body of the shirt once or twice, as needed, as shown in FIG. 8 and the shirt removed from the device 10 and stored. It is to be understood, first, that either side section can be used to initiate the folding process, and, second, that additional or fewer folding operations may be employed for different material that is to be folded. Other items such as long sleeve shirts, sweat shirts, sweaters, jackets, slacks, skirts, underwear, linens, towels, piece goods and other items can be folded with the above outlined series of folding steps. Some items, such as long sleeve shirts, may require additional repetitions of the folding steps.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A device for folding articles such as shins and other clothing, linens, towels and piece goods and having an expanded configuration adapted for storage and a folded configuration for use on a surface, comprising:

a generally flat rectangular-shaped main member having first and second sides and top and bottom edges having a first fold line extending longitudinally along said first side from said top edge to said bottom edge and a second fold line extending longitudinally along said second side of said main member from said top edge to said bottom edge, said first and second fold line dividing said main member into two approximately equal side sections and a mid-section; and, a foldable base having a plurality of scored panels and tab members capable of interlockingly folding together attached to said mid-section of said main member and having a substantially fiat expanded configuration and a raised folded configuration, such that said base can support and maintain said main member in a raised position above a fiat surface for facilitating folding of said first and second side sections of said main member.

2. The device of claim 1, wherein a first side of said base member has at least one aperture defined therein for receiving said at least one tab extending from said outer edge of said first panel and wherein a second side of said main member has at least one aperture defined therein for receiving said at least one tab extending from said outer edge of said second panel, said tabs being positioned proximate to said apertures when said first and said second panel perforated fold lines are folded inwardly with respect to said base member.

3. The device of claim 1, wherein said main member has a first generally rectangular-shaped arm member extending laterally from an upper corner of said first side section and a second generally rectangular-shaped arm member extending laterally from an upper corner of said second side section wherein each said arm member is dimensioned to be generally larger than the sleeve width of a conventional adult shirt.

4. A device for folding articles such as shirts and other clothing, linens, towels and piece goods and having an expanded configuration adapted for storage and a folded configuration for use on a surface, comprising:

a generally flat rectangular-shaped main member having first and second sides and top and bottom edges having a first fold line extending longitudinally along said first side from said top edge to said bottom edge and a second fold line extending longitudinally along said second side of said main member from said top edge to said bottom edge, said first and second fold lines dividing said main member into two approximately equal side sections and a mid-section;

a first generally rectangular-shaped arm member extending laterally from an upper corner of said first side section and a second generally rectangular-shaped arm member extending laterally from an upper corner of said second side section wherein each said arm member is dimensioned to be generally larger than the sleeve width of a conventional adult shirt; and a base attached to said mid-section of said main member and having an expanded configuration and a folded configuration comprising a generally flat rectangular-shaped base member having, a first and second sides and top and bottom edges, a generally rectangular shaped first side panel extending from said first side of said base member having an inner edge foldably attached to said first side of said base member at a first fold line, an outer edge having at least one tab extending therefrom, a top edge having a tab foldably extending therefrom and a bottom edge having a tab foldably extending therefrom, a perforated second fold line extending longitudinally along and generally midway between said outer and said inner edges of said first side panel, a generally rectangular shaped second side panel extending from said second side of said base member having an inner edge foldably attached to said second side of said base member at a third fold line, an outer edge having at least one tab extending therefrom, a top edge having a tab foldably extending therefrom and a bottom edge having a tab foldably extending therefrom, a perforated fourth fold line extending longitudinally along and generally midway between said outer and said inner edges of said second side panel, a generally rectangular shaped top panel extending from said top of said base member having an inner edge foldably attached to said top of said base member at a fifth fold line, an outer edge having at least one tab extending therefrom, a perforated sixth fold line extending horizontally along and generally midway between said outer and said inner edges of said top panel, and a generally rectangular shaped bottom panel extending from said bottom of said base member having an inner edge foldably attached to said bottom of said base member at a seventh fold line, an outer edge having at least one tab extending therefrom, a perforated eighth fold line extending horizontally along and generally midway between said outer and said inner edges of said bottom panel, wherein each of said sides, top and bottom of said base member has at least one aperture defined along the corresponding first, third, fifth and seventh fold lines therein dimensioned to receive said at least one tab on said outer edge of said foldably attached corresponding panels such that when said panels are folded along said perforated second, fourth, sixth and eight fold lines, and said first, third, fifth and seventh fold lines, said tabs can be inserted into said apertures to maintain said panels in a folded position,

* * * * *